US006256828B1

(12) United States Patent
Sauer

(10) Patent No.: US 6,256,828 B1
(45) Date of Patent: Jul. 10, 2001

(54) PAINT ROLLER

(75) Inventor: Helmut Sauer, Amtzell (DE)

(73) Assignee: FIA Farbwerkzeug GmbH & Co. KG, Wangen (DE)

( * ) Notice: Subject to any disclaimer, the term of this patent is extended or adjusted under 35 U.S.C. 154(b) by 0 days.

(21) Appl. No.: 09/171,103

(22) PCT Filed: Apr. 10, 1997

(86) PCT No.: PCT/DE97/00739

§ 371 Date: Oct. 13, 1998

§ 102(e) Date: Oct. 13, 1998

(87) PCT Pub. No.: WO97/38800

PCT Pub. Date: Oct. 23, 1997

(30) Foreign Application Priority Data

Apr. 12, 1996 (DE) ..... 196 14 426

(51) Int. Cl.[7] ..... B25G 1/00; B25G 1/10; B05C 1/08

(52) U.S. Cl. ..... 15/143.1; 15/230.11; D4/122; D4/138; 16/110.1; 16/430

(58) Field of Search ..... 15/230.11, 104.002, 15/143.1; D4/122, 138; 492/13, 19; 16/110.1, 436, 430

(56) References Cited

U.S. PATENT DOCUMENTS

| | | | | |
|---|---|---|---|---|
| D. 269,650 | * | 7/1983 | Allison | D4/4 |
| 2,517,247 | * | 8/1950 | Seley | 15/143.1 |
| 3,394,423 | * | 7/1968 | Bischoff | 15/230.11 |
| 3,623,179 | * | 11/1971 | Roth | 15/230.11 |
| 4,361,923 | * | 12/1982 | McKay | 15/230.11 |
| 4,557,011 | * | 12/1985 | Sartori | 15/230.11 |
| 4,570,280 | * | 2/1986 | Roth | 15/230.11 |
| 5,613,265 | * | 3/1997 | Gemmell | 15/230.11 |

FOREIGN PATENT DOCUMENTS

| | | | |
|---|---|---|---|
| 1219832 | | 6/1963 | (DE) . |
| 3037618A1 | | 4/1982 | (DE) . |
| 9309859 | | 1/1994 | (DE) . |
| 4426221A1 | | 1/1996 | (DE) . |
| 0672463A1 | | 9/1995 | (EP) . |
| 1260150 | | 8/1961 | (FR) . |
| 1070892 | * | 6/1967 | (GB) ..... 15/230.11 |
| 2263248A | | 7/1993 | (GB) . |

* cited by examiner

*Primary Examiner*—Gary K. Graham
(74) *Attorney, Agent, or Firm*—Venable; George H. Spencer; Robert Kinberg

(57) ABSTRACT

A paint roller consisting of a one-piece handle made of plastic provided with a handgrip and of a paint roll which can be mounted rotatably on the front end of the handle, in which the handle comprises over at least part of its length transversely running reinforcement elements which are interconnected in a reinforcing manner by longitudinal bracing.

19 Claims, 4 Drawing Sheets

PAINT ROLLER

BACKGROUND OF THE INVENTION

The invention relates to a paint roller.

Conventional paint rollers consist of a cylindrical roller body, also referred to below as a roller or paint roll, with an inner cylindrical tubular body which serves to receive a roller coating made of plush, felt or foamed material or similar material. In the interior of the tubular body, a slotted, radially widening clamp sleeve is generally provided. In one embodiment, on one side in the tubular body, the clamp sleeve is secured by a corresponding projection against axial displacement. On the other side, in the direction of the opening of the tubular body, an end piece is engaged in order to prevent the sleeve falling out. In many cases, the end piece, like the clamp sleeve, is also rotatably mounted and both individual parts serve to receive and bear a handle to be inserted into the roller body. The clamp sleeve performs the function of fixing the roller body axially on the handle. The handle as a rule consists of a bent metal wire and, on its lower end, a handgrip made of plastic.

Such a construction nevertheless suffers from disadvantages. On the one hand, a number of individual parts are necessary for the paint roller, which is frequently thrown away after use, and these parts not only make production more expensive but are also undesirable from an environmental point of view. In particular the construction of the handle as a combination of metal and plastic which is injection-molded on can be exploited only with great difficulty in raw material recovery.

For this reason, attempts have been made in the past to manufacture the handle from plastic as a single piece.

In some embodiments, however, it had to be admitted that the handle does not have adequate stability for the practical application.

It is true that adequate stability is achieved in other embodiments through the use of fiber-reinforced plastics, but this makes production more expensive at the same time. The possibility exists, moreover, of simply dimensioning the handle so it is larger but this leads to increased material consumption and is therefore equally inadvisable for reasons of cost.

SUMMARY OF THE INVENTION

The object of the invention is to provide a paint roller with a one-piece handle made of plastic which, using a small amount of material and with low production costs, has a rigidity comparable with that of a conventional handle made of, for example, metal wire. Furthermore, a simple and effective and at the same time universal possibility for fastening between the handle and the roller body is to be ensured.

The invention pertains to a paint roller that consists of a one-piece handle made of plastic provided with a handgrip and of a paint roll which can be mounted rotatably on the front end of the handle. The handle comprises over at least part of its length transversely running reinforcement elements which are interconnected in a reinforcing manner by longitudinal bracing. In this way, as is the case in the ribbing of an aircraft aerofoil made of frames and spars, excellent rigidity is achieved with low weight. It is consequently not necessary to use a plastic which is, for example, fiber-reinforced, and this results in reduced production costs. Moreover, the circumstance that comparatively less material is necessary for production contributes to a further reduction of the costs. The low weight of the construction of the handle has the advantage for the user of bringing on fatigue less rapidly in the execution of tedious work.

In order to form the reinforcement particularly efficiently, it is furthermore proposed to make the longitudinal bracing by means of wall sections. In this respect, it is especially preferred to design the wall sections as an open hollow profile and in particular as a half-shell. In the case of a hollow profile, the reinforcement elements are expediently arranged on its inner side.

So as to achieve a comfortable and ergonomic handgrip, it is further proposed to make the transversely running reinforcement elements protrude on the open side of the hollow profile at least in the region of the handgrip. The three-dimensional shape of the handgrip is thus defined on one side by the outer contour of the hollow profile and on the other side by the shape of the reinforcement ribs. In this respect, it is advantageous if the reinforcement elements have a spacing of 2 to 6 mm so as to avoid pressure points in the hand of the user.

To optimize the use of material in production, it is also proposed that the spacings of the reinforcement elements arranged outside the handgrip are greater than those of the reinforcement elements arranged in the region of the handgrip.

For the same reasons, it is furthermore proposed to make the width and/or the cross section of the hollow profile decrease continuously or at least by sections from the handgrip to the front end of the handle.

So as to achieve a further improvement of the quality of grip of the handle, it is furthermore proposed to provide a ribbed grip surface on the outer side of the hollow profile at least in a part region of the handgrip.

To achieve great rigidity and to save production material, it is moreover proposed to make the front part of the handle, in front of the region where the paint roll is received, in the form of a U-shaped profile. This region is preferably also ribbed to increase stability.

In an especially preferred embodiment, the front region of the handle is also designed directly as a roller bearing for a roller body, which here too is referred to as a paint roll or roller. In this way, the number of individual parts of which a paint roller is usually composed is reduced. For example, the clamp sleeve described in the state of the art and the end piece for fixing the clamp sleeve can preferably be formed on in one piece at the front end of the handle to produce the roller bearing in the present invention. The handle can accordingly be designed in its end region in such a manner that it engages in such a manner in a groove or the like provided on the inner side of the tubular body that the tubular body rotates on the handle itself. In order to obtain a simple construction, it is proposed to make the paint roll so that it can engage on the roller bearing at the front end of the handle. In this respect, it is advantageous if the roller bearing has an engagement web for engaging in a circumferential groove in the tubular body of the paint roll. In this respect, the dimensions of the engagement web and the groove are preferably to be fixed in such a manner that the paint roll is rotatable about its longitudinal axis. Mutual transposition of the engagement web and the groove on the respective parts may be advantageous.

For especially advantageous mounting of the paint roll, it is furthermore proposed to arrange the engagement web in the region of the center of the roller bearing.

In order to ensure stable rolling of the paint roll on the roller bearing, at least one additional bearing web can be provided, on which the tubular body of the paint roll can run and is supported against tilting.

Lastly, it is advantageous if a limit web is provided on the roller bearing for the handle-side end of the rotatably mounted paint roll. The limit web prevents paint being able to enter into the tubular body of the roll. The limit web furthermore defines the mounting travel, i.e. the insertion length can be predetermined in this way.

In special cases, it may also be advantageous if the connection between the roller bearing and the tubular body is made via a separate clamp sleeve or adhesion bush which has the corresponding engagement means in its inner tubular surface. In this way, a simple cylindrical tubular body of suitable length in each case can be used, into which the clamp sleeve is introduced by a simple press fit.

BRIEF DESCRIPTION OF THE DRAWINGS

A number of exemplary embodiments of the invention are illustrated in the drawings and explained in greater detail in the description below, in which further advantages and details are indicated.

DETAILED DESCRIPTION OF THE PREFERRED EMBODIMENTS

Figure 1:
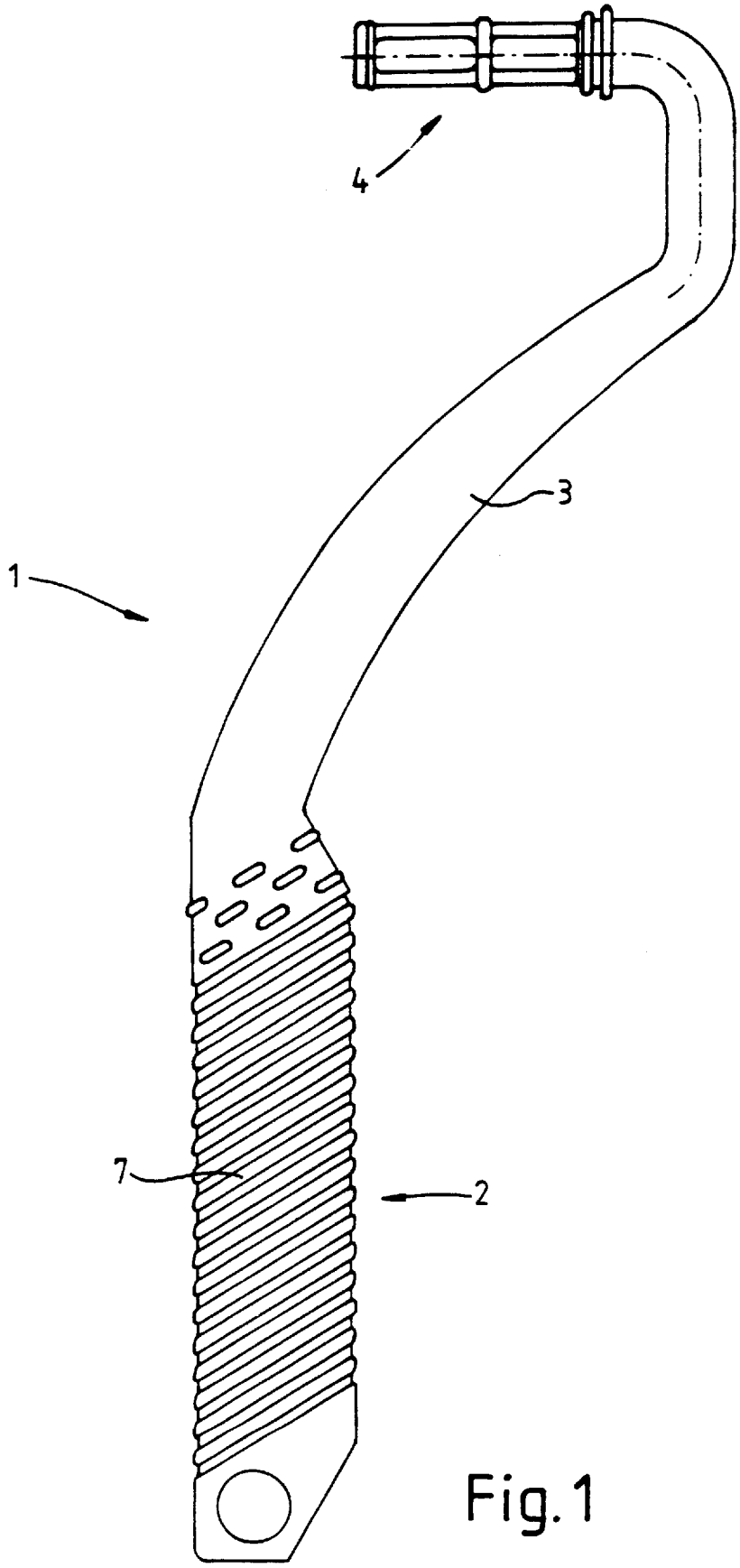
FIG. 1 shows a front view of a paint-roller handle according to the invention.
Figure 2:
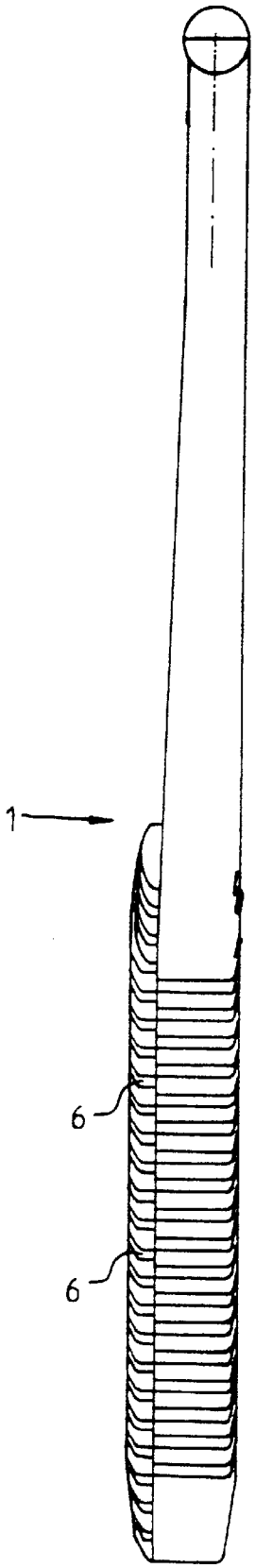
FIG. 2 shows a side view from the left of the handle from FIG. 1.
Figure 3:
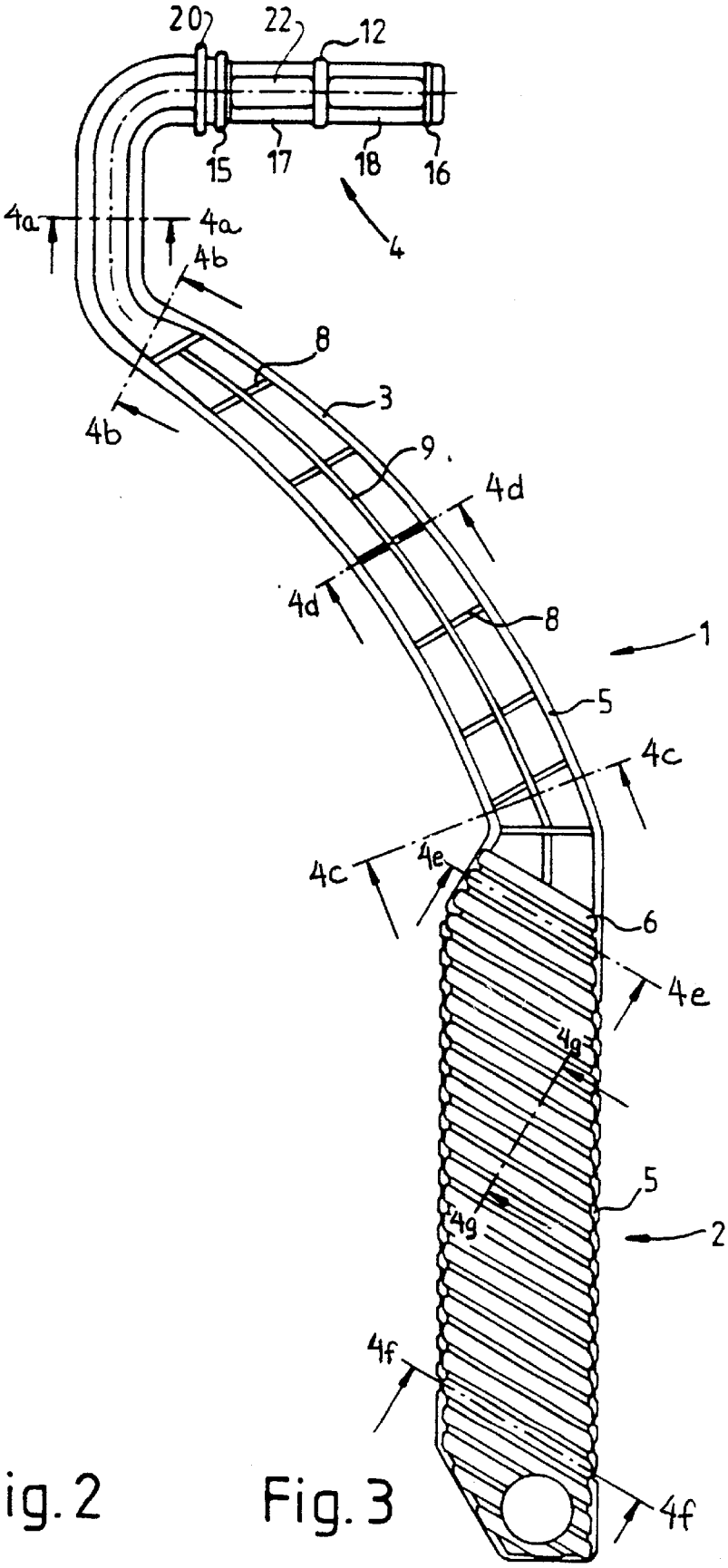
FIG. 3 shows a rear view of the handle from FIG. 1 , FIGS. 4*a* to *g* show cross sections along the handle according to the section lines drawn in in FIG. 3.
Figure 4A:
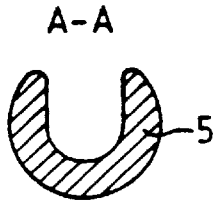
Figure 4B:
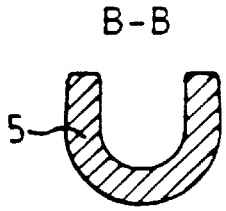
Figure 4C:
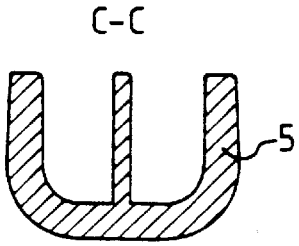
Figure 4D:
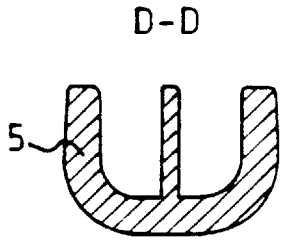
Figure 4E:
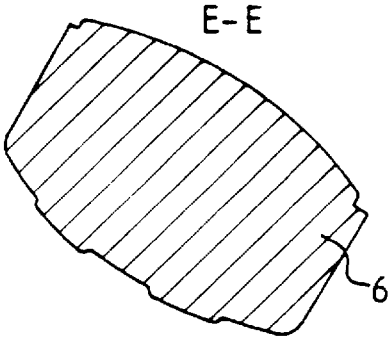
Figure 4F:
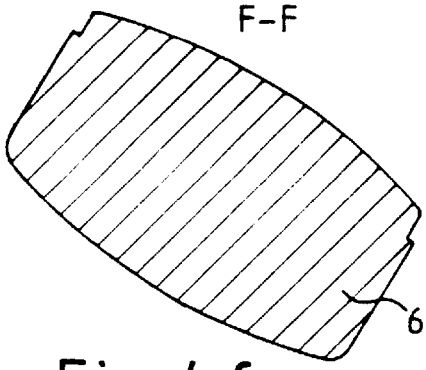
Figure 4G:
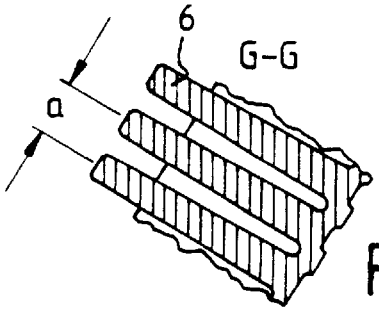

A first exemplary embodiment of a handle according to the invention for a paint roller is illustrated in FIGS. 1 to 3 and the associated cross sections in FIGS. 4*a* to *g*. The cross sections in FIGS. 4*a* to *g* are drawn on a scale of 2:1. The handle 1 is made from plastic as a single piece. It comprises a handgrip 2 at its lower end and a roller bearing 4 running roughly perpendicularly to the handgrip at its upper end. In between, there is a curved connecting part 3. The connecting part 3 and the handgrip 2 are formed essentially by a hollow profile 5 which is open on one side (see in this respect the sections in FIGS. 4*a* to *b*). In the region of the handgrip 2, the hollow profile 5 is reinforced by transversely running ribs 6. By way of example, ribs or reinforcement elements are illustrated in FIG. 4*e* and FIG. 4*f* along the section lines 4*e*—4*e* and 4*f*—4*f* respectively (see FIG. 3). The reinforcement elements 6 are arranged at a comparatively narrow spacing a of preferably 3 mm (see in this respect FIG. 4*g* in particular). On the open side of the hollow profile 5, the reinforcement elements 6 protrude above the latter so that the three-dimensional shape of the handgrip 2 is defined on one side by the hollow profile 5 and on the other side by the outer edges of the reinforcement elements (FIG. 2). As is clear in particular in FIG. 2, the outer side of the hollow profile is ribbed in the region of the grip surface 7 of the handgrip 2 to improve the quality of grip.

In the region of the connecting part 3 as well, for reinforcement purposes, there are transversely running ribs or reinforcement elements 8 in the hollow profile 5. However, the spacing of the reinforcement elements is clearly greater than in the region of the handgrip 2. Moreover, the reinforcement elements do not protrude above the open side of the hollow profile. To further improve the stability, the last transverse rib of the handgrip 2 and all other subsequent transverse ribs 8 of the connecting part 3 are connected by a longitudinal web 9 running in the central region of the hollow profile (see in particular in this respect the sections 4*c* and 4*d*).

Reinforcement by the longitudinal web 9 and the reinforcement elements 8 is not effected, however, over the entire region of the connecting part 3 but only from the handgrip via a first curve and into the region of the next bend. From here, the hollow profile 5, which until that point was narrowing in cross section, continues as far as the roller bearing 4 in the form of a U-shaped profile without additional reinforcement elements (cf. in this respect the cross sections in FIGS. 4*a* and 4*b*), in particular with its width or cross section unaltered as far as the roller bearing 4. Alternatively, this region may also be provided with additional reinforcement elements.

The roller bearing 4 at the end of the connecting part 3 serves for directly receiving and rotatably mounting a cylindrical roller body with an appropriate roller coating.

Figure 5:
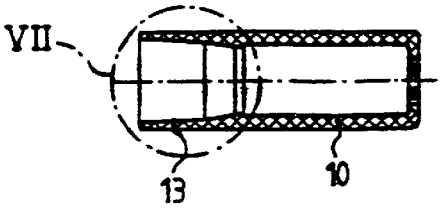
FIG. 5 shows a first tubular body according to the invention for a paint roll or roller in longitudinal section.
Figure 6:
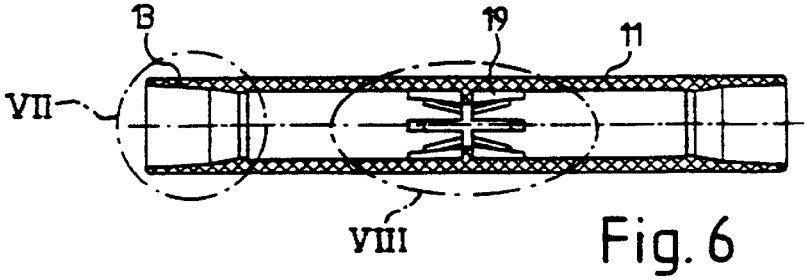
FIG. 6 shows a second tubular body for a roller in longitudinal section.
Figure 7:
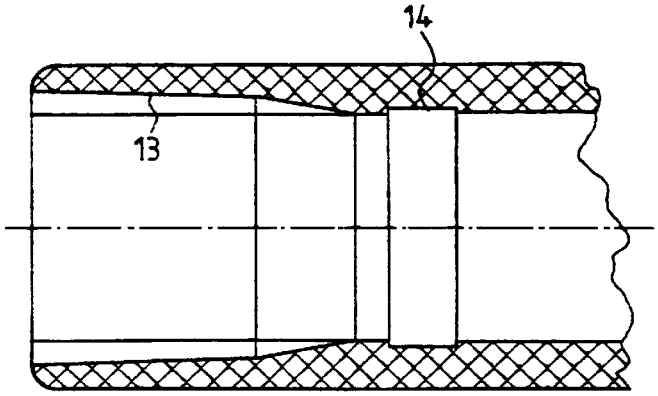
FIG. 7 shows an enlargement of detail VII from FIG. 5 and FIG. 6

In FIGS. 5 and 6, such rollers are illustrated without plush or foamed-material coating, in other words only by their tubular bodies 10, 11, on which the roller coating is to be arranged. The tubular bodies 10, 11 are simply pushed onto the roller bearing 4 and engaged. For engagement, a circumferential engagement web 12 on the roller bearing 4 slides along a cone 13 on the inner side of the tubular bodies 10, 11 into a likewise circumferential groove 14 on the inner side of the tubular bodies 10, 11. The dimensions of the engagement web 12 and of the groove 14 are defined in such a manner that, while the engagement web engages in the groove, rotation of the tubular body and with it the roller is nevertheless made possible in the direction of the course of the groove.

The engagement web 12 is positioned roughly centrally on the roller bearing 4. At a spacing from it, on the left and the right respectively, further webs 15, 16 are arranged on recessed connecting elements 17, 18 or connecting cylinders. The recesses 22 serve to save material. The webs 15, 16 form a bearing for the tubular body 10 or 11, on which it runs during rotary movement and is supported against tilting forces. This is particularly important when the tubular body protrudes far beyond the roller bearing 4 in the pushed-on state, as is the case of that illustrated in FIG. 6.

The tubular body 11 is, for example, twice the length of the tubular body 10 and can, owing to its symmetrical construction, be pushed onto and engaged on the roller bearing 4 on both sides.

Figure 8:
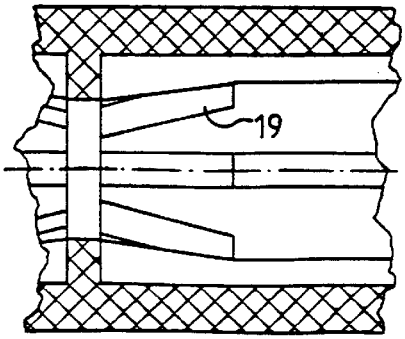
FIG. 8 shows an enlargement of detail VIII from FIG. 6.

The bracing elements 19 in the center of the tubular body 11 in the detail VIII are illustrated again in FIG. 8 on enlarged scale. They also serve as a stop for movement of the roller body 4 inside the groove 14 in the axial direction.

In order to cover the tubular body 10, 11 on the side of the handle, a limit web 20 is present at the inner edge of the roller bearing. This web can, for example, also take over the function of sealing the tubular body 10, 11 against paint penetration, provided the other side of the tubular body is also adequately sealed by the roller coating. Furthermore, the web 20 constitutes a travel limit during assembly.

Figure 9:
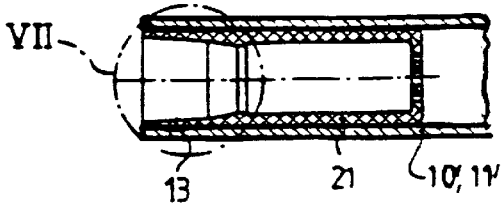
FIG. 9 shows a separate clamp sleeve for the tubular body.

According to a variant of the invention, the tubular body 10, 11 is not itself designed in its respective end region as an "adhesion bush" or "clamp sleeve" for the roller bearing 4, but a separate part is provided for this. In FIG. 9, a separate adhesion bush or clamp sleeve 21 is therefore illustrated, which in principle has the same construction as the tubular body according to FIG. 5 but is introduced as a separate part into a cylindrical inner tube of the roller body 10', 11', or of the paint roll by means of a press fit or the like. As a result, it is true that a further part (adhesion bush) is required. However, normal, cylindrical tubes, which are to be cut into lengths and can be coated optionally with plush or foamed material, can be used as roller bodies.

What is claimed is:

1. A paint roller for use with a roller body, comprising:

a one-piece plastic handle having a front end on which the roller body is mountable, a handgrip, and a connecting part connecting the handgrip to the front end, wherein the handle comprises along at least part of the length of the handle a plurality of transversely running reinforcement elements which are interconnected by longitudinal bracing to reinforce the handle, and wherein the longitudinal bracing comprises wall sections having a U-shaped hollow profile with an open side having a pair of edges, and wherein the transversely running reinforcement elements protrude beyond the edges of the hollow profile on the open side of the hollow profile at least in a region of the handgrip to define a three-dimensional shape of the handgrip.

2. The paint roller as claimed in claim 1, wherein the longitudinal bracing comprises wall sections.

3. The paint roller as claimed in claim 1, wherein the longitudinal brace elements comprise wall sections having a U-shaped, hollow profile with an open side.

4. The paint roller as claimed in claim 3, wherein the reinforcement elements are arranged on the inner side of the hollow profile.

5. The paint roller as claimed in claim 1, wherein the transversely running reinforcement elements are spaced from each other by a fixed spacing, at least in the region of the handgrip to avoid pressure points in the hand of the user.

6. The paint roller as claimed in claim 5, wherein the spacing is in a range between 2mm to 6mm.

7. The paint roller as claimed in claim 1, further comprising second reinforcement elements arranged in the connecting part, wherein the second reinforcement elements arranged in the connecting part have a greater spacing therebetween than a spacing of reinforcement elements arranged in the handgrip.

8. The paint roller as claimed in claim 1, wherein the handle has a profile and one of the width and the cross-section of the hollow profile decreases by one of a continuous or a sectional decrease from the handgrip to the front end of the handle.

9. The paint roller as claimed in claim 1, wherein the handle has a hollow profile and a ribbed grip surface is provided on an outer side of the hollow profile at least in part of the handgrip.

10. The paint roller as claimed in claim 1, wherein the front end of the handle comprises a U-shaped profile.

11. The paint roller as claimed in claim 1, wherein the front end of the handle forms a roller bearing adapted for receiving the roller body, the roller body adapted to be mounted rotatably on the roller bearing directly.

12. The paint roller as claimed in claim 11, wherein the roller body is connected engageably to the roller bearing at the front end of the handle.

13. The paint roller as claimed in claim 11, wherein the roller bearing has an engagement web for engaging in one of a circumferential groove of the roller body and a corresponding groove in an adhesion bush inside the tubular body.

14. The paint roller as claimed in claim 13, wherein the engagement web is arranged in a region of the center of the roller bearing.

15. The paint roller as claimed in claim 11, wherein the roller bearing comprises at least one bearing web at one of its ends.

16. The paint roller as claimed in claim 11, wherein a limit web is provided on the roller bearing at the handle-side end thereof.

17. The paint roller as claimed in claim 11, wherein the roller bearing is connected engageably to a tubular body via a separate adhesion bush held inside the tubular body via a press fit.

18. The paint roller as claimed in claim 1, wherein the front end of the handle forms a roller bearing adapted for receiving the roller body and the roller body is adapted to be mounted rotatably on the roller bearing indirectly by one of a separate adhesion bush and a clamp sleeve.

19. The paint roller as claimed in claim 1, wherein the longitudinal bracing comprises a pair of longitudinal brace elements each disposed along one longitudinal side of the connecting part respectively and at least on central longitudinal web extending longitudinally and spaced from and located between the brace elements to reinforce the handle.

* * * * *